US005943789A

United States Patent [19]

Yamamoto

[11] Patent Number: 5,943,789

[45] Date of Patent: Aug. 31, 1999

[54] TREATMENT APPARATUS FOR SEASONING WOOD FOR STRUCTURAL USES

[75] Inventor: Masahiro Yamamoto, Ome, Japan

[73] Assignee: Yugen Kaisha Yamamoto Kagu Seisakusho, Tokyo, Japan

[21] Appl. No.: 09/028,001

[22] Filed: Feb. 23, 1998

Related U.S. Application Data

[62] Division of application No. 08/646,636, May 8, 1996, Pat. No. 5,752,328.

[30] Foreign Application Priority Data

Apr. 9, 1996 [JP] Japan ..... 8-112045

[51] Int. Cl.[6] ..... F26B 7/00

[52] U.S. Cl. ..... 34/418; 34/217; 34/381; 34/491

[58] Field of Search ..... 34/77, 92, 242, 34/225, 418, 423, 340, 381, 474, 491, 493

[56] References Cited

U.S. PATENT DOCUMENTS

| | | | |
|---|---|---|---|
| 1,567,559 | 12/1925 | Welch | 34/428 |
| 3,757,428 | 9/1973 | Runciman | 34/340 |
| 4,106,215 | 8/1978 | Rosen | 34/217 |
| 4,467,532 | 8/1984 | Drake | 34/92 |
| 4,893,415 | 1/1990 | Moldrup | 34/92 |
| 5,228,209 | 7/1993 | Brunner | 34/77 |
| 5,325,604 | 7/1994 | Little | 34/493 |

FOREIGN PATENT DOCUMENTS

| | | |
|---|---|---|
| A-2-28073 | 1/1990 | Japan . |
| A-4-148484 | 5/1992 | Japan . |

*Primary Examiner*—Henry Bennett
*Assistant Examiner*—Pamela A. Wilson
*Attorney, Agent, or Firm*—Oliff & Berridge, PLC

[57] ABSTRACT

The invention relates to an apparatus for treating green woods for the purpose of creating lumber of suitable quality for the implementation of building. The woods are placed in a treatment chamber with a sealed atmosphere, the temperature of the chamber is increased, and the woods are maintained at a specific temperature and humidity for a given period of time, the woods are the sprayed with hot water until the moisture content of the woods are allowed to decrease to a desired value.

4 Claims, 5 Drawing Sheets

TREATMENT APPARATUS FOR SEASONING WOOD FOR STRUCTURAL USES

This is a Division of application Ser. No. 08/646,636, filed May 8, 1996, and issued as U.S. Pat. No. 5,752,328 on May 19, 1998.

BACKGROUND OF THE INVENTION

1. Field of the Invention

The present invention relates to a treatment method for green woods and an apparatus thereof, to which necessary natures as industrial lumber are given.

2. Description of the Prior Art

In general, lumbers are obtained by cutting down woods as a living thing and sawing them, and in case of using them as the lumber for building use, they exhibit the superior properties such as keeping a room environment comfortable and increasing the durability of the building by absorbing and discharging moisture depending on the temperature and humidity of the lumbers themselves. These properties are obtained by making use of the nature of woods as living thing appropriately. However, since the lumbers are living, the defects such as distortion and cracking (hereinafter referred as "distortion") after sawing are unavoidable, in case of considering as lumber for industrial use, there is a difficulty for handling those from the viewpoint of the quality stability.

Hence, a process has been conventionally indispensable, wherein after subjecting green woods to seasoning for a long period of time and at the time, when the woods are no longer distorted, sawing is carried out. However, depending on the kind of the woods and places located, the distortion has never sat down even after subjecting to long years seasoning, accordingly there are actually many kinds of woods which are recognized as not suitable for the lumber for building use (actually little woods are suitable for lumber for building use). Accordingly, a specific kind of wood is prized highly for lumber for building use, which invites not only high prices but also the destruction of the natural ecosystem by replacing a certain kind of copsewood with the specific kind of woods. Further, in a wood, which comprises portions of woods easily distorted and portions of woods little distorted, and the portions to be able to be used as lumber for building use are naturally limited, so that the area of forest to be cut down is large to obtain a given amount of lumbers, which may be an invitation to environmental destruction.

In addition, even in an appropriate wood for lumber for building use, the period of time necessary for seasoning, to which woods are subjected after cutting down, depends variously on the kinds of wood, and some of those woods necessitate ten years. During such term, the cost of hands for management and land required therefor becomes very expensive, in addition a stable supply to the market corresponding to the demand is quite difficult, which leads to a further increase in cost. Therefore, for the purpose of changing the nature of woods which are usable as lumber for building use to a wood which is used therefor as soon as possible, a method for adding an artificial treatment to a wood has been considered in a conventional art.

For example, the wood is laid in a treatment chamber, and subjected to a hot air for a given period of time to dry the conduits unreversely and change the nature of the tissue of the wood has been carried out, so that any generation of such as ex post facto cracking or bending has been prevented. In the case where a pine tree is treated in this treatment, a great amount of turpentine is discharged in melted manner and the remaining turpentine can be changed to such nature as low in viscosity, which causes to increase the workability in sawing and the quality of appearance. As the conventional examples, in the Patent Publication No. Hei 2-28073 and so on such details are disclosed. Further, a wood drying apparatus, in which the blast of a hot air in a treatment chamber is discussed and the efficiency is increased is disclosed in the Patent laid-open No. Hei 4-148484.

However, in the conventional wood treatment method and the apparatus thereof the following problems have been mentioned. As described above, in the method where any green wood is treated by adding artificial treatment, such as exposing the green woods to the hot blast and drying the woods, the change of the nature of the woods is carried out to prevent the woods from generating the ex post facto cracking or bending.

However, the nature-changed-status of the woods treated in the high temperature will destroy the balance of the internal stress when returning again to the normal temperature, and during the time process from a high temperature to a normal temperature, a cracking generation has been invited. Actually, the generation of cracking is apt to be experienced in 80% of the woods within one to two weeks after taking out from a treatment chamber and leaving as it is in the outer atmosphere. Thus, a technique for accelerating the nature change of the wood in order to increase the nature as lumber for building use and deriving the stable supply and the cost reduction of lumbers is not sufficient yet, and a further improvement for treating woods efficiently has been expected.

SUMMARY OF THE INVENTION

The present invention has been made in the light of the above problems, the purpose of it is, as to the kind of woods which has to be handled as the lumbers for building, to shorten the term in which the nature of the lumber for building use is obtained, and even as to the woods which have been handled conventionally not suitable for use of the lumber for building use, to change the nature of the woods in the state in which the wood is usable as the lumber for building use, and to supply a great amount of the nature changed woods stably while preventing the cost from increasing and preventing the environmental destruction.

In order to solve the above problems, the wood treatment method according to the present invention is characterized in comprising the following steps of putting the woods in a sealed atmosphere, increasing the temperature of the sealed atmosphere to a given value, maintaining the woods for a given period of time at a certain temperature and humidity, taking out the woods from the sealed atmosphere, spraying the woods with a hot water having a given temperature and drying the woods until the moisture content rate thereof decreases to a given value.

By keeping the woods in a sealed atmosphere at a given temperature and a given humidity uniformly for a given period of time, the tissue of the wood is softened by steaming. At that time, the sealed atmosphere is kept uniformly at the given temperature and humidity, thereby all woods are steamed uniformly. Then, the materials, such as the lignin and the cellulose and so on, which are located unevenly in the wood tissue and cause the generation of internal stress, which generates an ex post facto distortion, are melted and distributed throughout the tissue. In this treatment, a given amount of the moisture of the wood is vaporized. In this state, the distribution balance of the lignin and the cellulose is destroyed which hitherto contributes to keep the balance of the internal stress and, particularly, the portion where the lignin and the cellulose have been located densely becomes thin in respect to the materials, which generates a state in which the gaps are formed in the tissue. Here, by soaking the woods with a hot water by spraying the woods with the hot water, the water is filled in those gaps, which causes the tissue to swell as the woods were before treatment and to restore the balance of the internal stress as before. From this state, in the process of drying the woods until the moisture content rate reaches to a given value, by vaporizing gradually the water filled in the gaps of the tissue, the tissue becomes familiar with the evenly distributed lignin and cellulose, which eventually prevents the uneven internal stress at the normal temperature.

In the present invention, the removal of the woods from the above mentioned atmosphere is carried out when the core temperature of the woods becomes less than a given temperature, and the temperature of the hot water sprayed is preferably higher than the core temperature. As said previously, because the soaking of the hot water into the woods is necessary, when the core temperature of the woods is less than the boiling point of the water and becomes more than the solidification point of the lignin and the cellulose, the spraying is carried out. At that time, because of the spraying of the hot water of the temperature higher than the core temperature, the generation of cracking is prevented due to an abrupt change of the temperature.

Further, in the present invention, it is preferable to accord the increasing rate with the decreasing rate of the temperature in the sealed atmosphere. Thereby, the generation of cracking due to the abrupt change of temperature is prevented.

Further, the woods treatment apparatus of the present invention in order to solve the above problems comprises a hot blast supply furnace, a treatment chamber and a hot water supplier, in which the treatment chamber is provided with a stirring fan, a ventilator and a sensor, and the treatment chamber and the hot blast supply furnace are connected with a duct having a damper, and a control means which controls the damper, the stirring fan and the ventilator based on the temperature and the humidity detected by the sensor in the treatment chamber, and the hot water supplier is located adjacent to the inlet and outlet opening for the treatment chamber.

By controlling the stirring fan and the ventilator provided in the treatment chamber, the damper provided on the duct connecting the treatment chamber and the hot blast supply furnace based on the temperature and the humidity detected by the sensor in the treatment chamber, the temperature and the humidity in the treatment chamber are leveled off and kept stable and uniform. And, the hot water supplier sprays the woods with a hot water, the woods being taken out from the treatment chamber through the adjacent inlet and outlet opening. Now, in the present invention, a plurality of jets provided on the duct are preferably disposed on the floor of the treatment chamber appropriately. By this arrangement, the hot blast is spouted uniformly in the treatment chamber and the convection of the hot blast from the floor to the ceiling acts to keep the temperature in the chamber uniform. Further, in the present invention, it is preferable to provide sensors for detecting the temperature and the humidity of the woods. During the process of treating the woods, by adding the data of the temperature and the humidity detected directly in the treatment chamber to the material to be considered, the correct treatment of the woods is obtained.

DESCRIPTION OF THE PREFERRED EMBODIMENT

Figure 1:
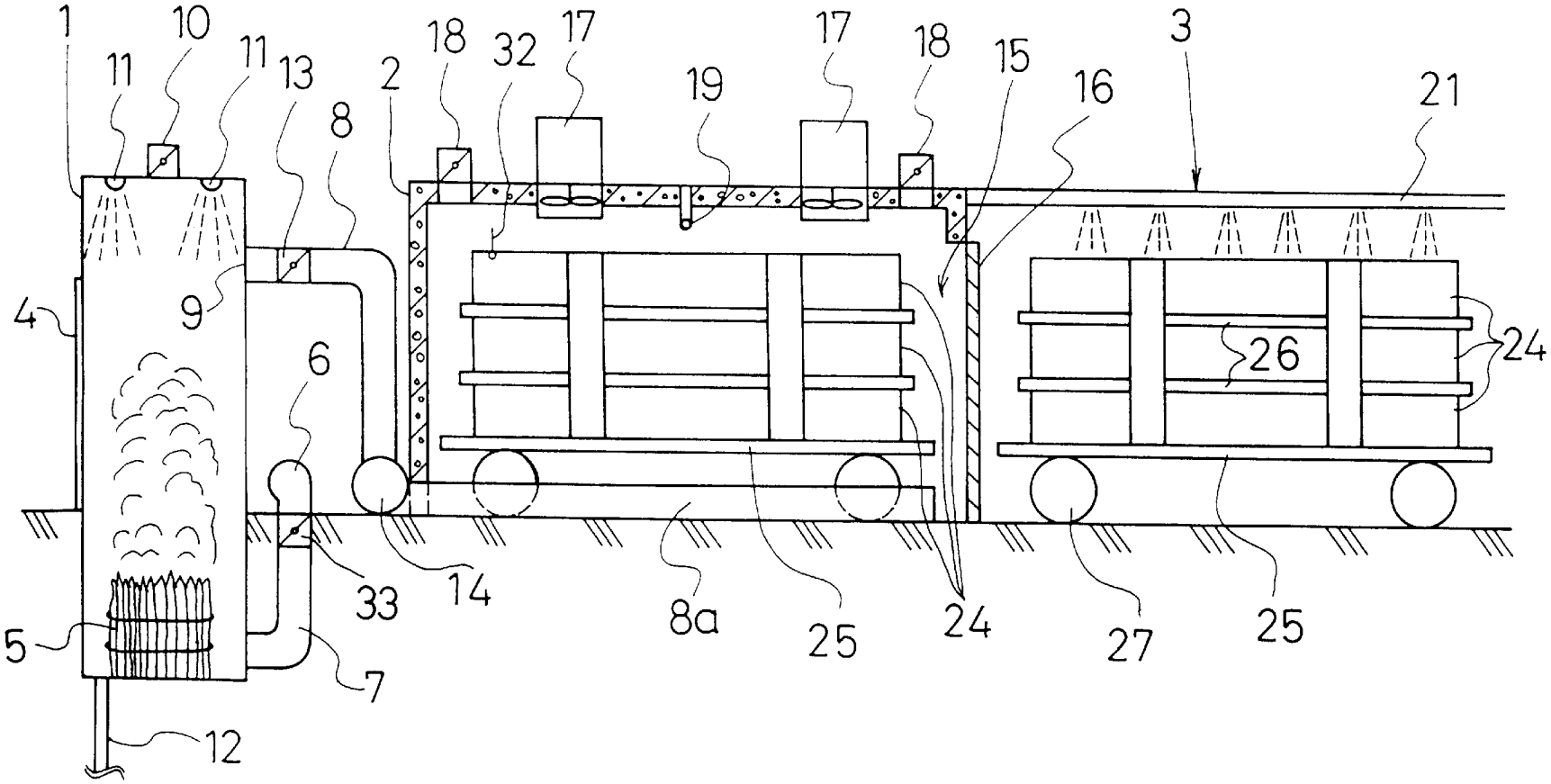
FIG. 1 is a schematic drawing showing the main portion of the woods treatment apparatus illustrating the present invention.
Figure 2:
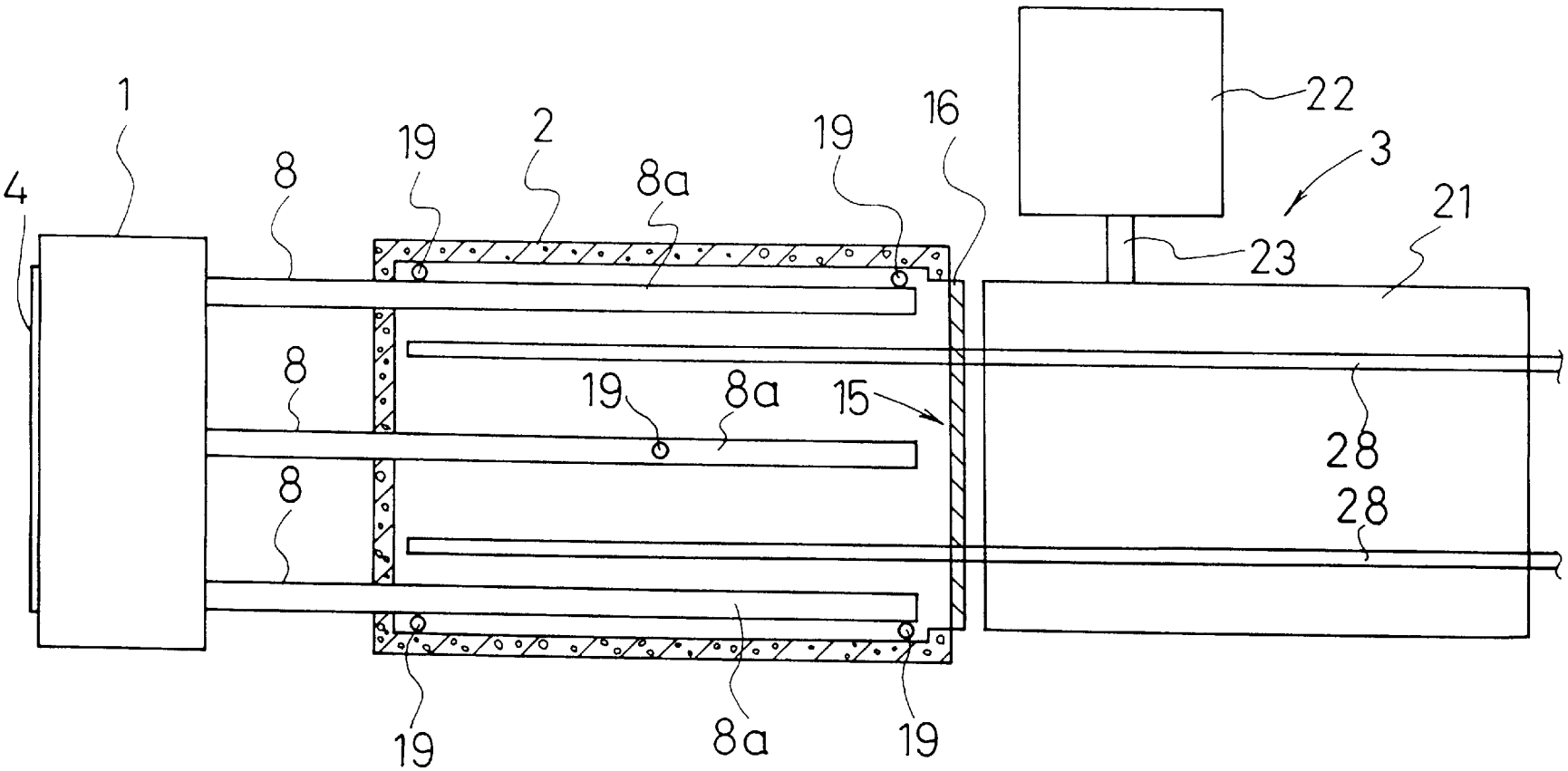
FIG. 2 is a top view of the woods treatment apparatus shown in FIG. 1.

In FIGS. 1 and 2, a woods treatment apparatus according to the embodiment of the present invention is shown.

This woods treatment apparatus comprises a hot blast supply furnace 1, a treatment chamber 2 and a hot water supplier 3. Here first, the hot blast supply furnace 1 will be explained. The hot blast supply furnace 1 is embedded under the ground in its lower half, and a door 4 for supplying fuel is located on the ground. The lower portion of the hot blast supply furnace 1 is provided with a ventilation pipe 7, at the top of which is mounted a ventilation fan 6 through a damper 33 to regulate ventilation volume. An inlet 9 of a duct 8 which connects the hot blast supply furnace 1 and the treatment chamber 2 is provided at a high portion of the hot blast supply furnace 1 and efficiently takes in an ascending hot blast. Further, on the ceiling of the hot blast furnace 1 there are provided a chimney 10 and sprinklers 11. The hot blast supply furnace 1 has a capacity to accept the fuel 5 to continue to supply the hot blast for a four day period during the treatment processes described later. As the fuel 5, housing waste woods seem to be advantageous from the cost viewpoint, but not limited thereto. In general, a certain amount of the housing waste woods are traded in bundles, so that such bundled housing waste woods can be lifted with a crane and thrown into the furnace directly through the opening where the door 4 of the hot blast supply furnace 1 is opened. Further, as the combustion has to last continuously (for example, for four days), the combustion speed has to be regulated, so that the sprinkler 11 can spout a regulated water. In addition, in case the temperature in the furnace becomes too high, an excessive hot blast can be exhausted from the chimney 10. To avoid water from the sprinkler 11 flooding the furnace, there are provided drains 12 which are in communication with a deposition port. Still further, thermal sensors are provided in the furnace, and based on the detected temperature, the chimney 10 and the sprinkler 11 can be controlled, thereby the temperature in the hot blast supply furnace 1 and the combustion speed of the fuels 5 are carried out automatically.

In the duct 8 intermediately, a damper 13 is provided to regulate the amount of the hot blast to feed from the hot blast supply furnace 1 to the treatment chamber 2. Further, the duct 8 is provided with a ventilation fan 14 which may force the duct 8 to suck the hot blast from the hot blast supply furnace.

Next, an explanation about the treatment chamber 2 will be provided. The treatment chamber 2 is built with reinforcement concrete in its wall and upper portion having thickness of 300 mm and an entrance and exit 15 for woods is sealed by a door 16. The door 16 is made from ferrous plate having a layer of concrete on the inner side thereof facing inside the treatment room 2. On the ceiling of the treatment chamber 2, a plurality of stirring fans 17 and ventilator 18 are provided. And, a plurality of sensors 19 (hereinafter referred as "temperature and humidity sensor") for detecting the temperature and the humidity. In the embodiment of the present invention, the stirring fan 17 and the ventilator 18 are provided at two positions respectively, the thermal and humidity sensors 19 are disposed with one at the center of the treatment chamber 2 and one at each of the four corners of the chamber for a total of five (FIG. 2).

Figure 3:
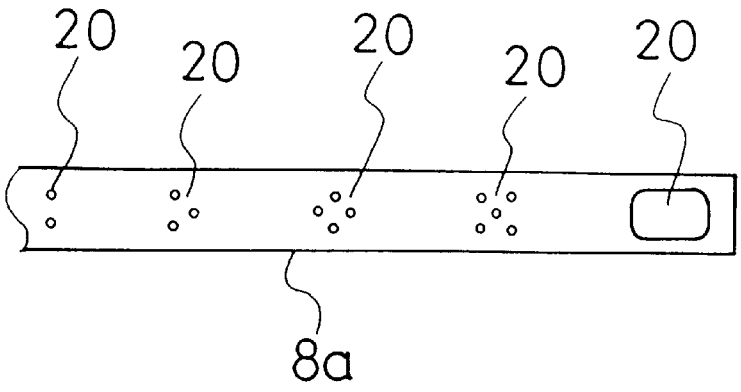
FIG. 3 is an enlarged view showing the details of the duct shown in FIG. 2.

The duct 8 connecting the treatment chamber 2 and the hot blast supply furnace 1, as shown in FIG. 2, is formed of three pieces, the extended portions 8*a* of the pieces are disposed at the center portion and at both side portions of the treatment chamber 2. On the extended portions 8*a,* there are provided, as shown in FIG. 3, a plurality of jets 20 disposed from the root portion toward the tip end (from left to right as viewed in FIG. 3). Wherein toward the tip end, the size of the opening of the jet 20 is larger. Thus, by providing a plurality of the ducts 8 and the jets 20 at the appropriate portions, on the floor of the treatment chamber 2, the hot blast is spouted uniformly from everyjet in the treatment chamber 2. The extended portion 8*a* of the duct 8 can be embedded in the floor of the treatment chamber 2, further it can be formed by providing a cover having the jets 20 which covers a groove provided in the floor.

Figure 7:
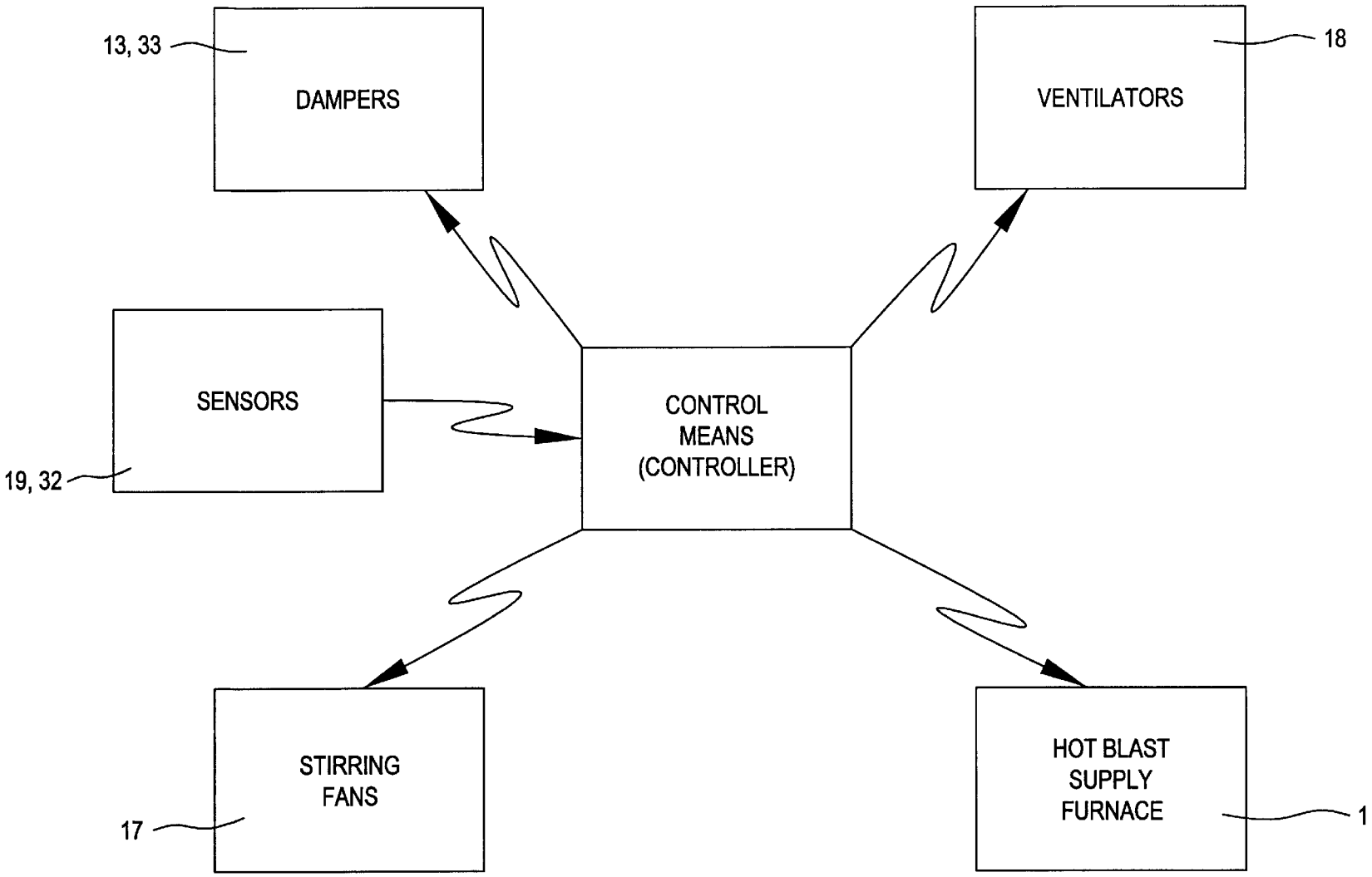
FIG. 7 is a simplified block diagram showing the control system.

Further, based on the temperature and the humidity detected in the treatment chamber 2 by the temperature and humidity sensors 19, the stirring fans 17 and the ventilators 18 can be controlled by a control means (for example, a personal computer memorizes the data as a program, such as of the temperature, the humidity, the amount of blast and opening and closing of every damper, and controls) (FIG. 7). In addition, the control means can control the damper 13 provided on the duct 8. Therefore, the temperature and the humidity in the treatment chamber 2 can be controlled approximately evenly and uniformly, by an automatic control of the damper 13, the stirring fans 17 and the ventilators 18. Thus, it is quite important to keep the temperature and humidity in the treatment chamber 2 uniform, when carrying out an uniform treatment on the plurality of woods 24 laid in the treatment chamber 2.

Next, the hot water supplier 3 is explained. The hot water supplier 3 is preferably provided adjacent to the entrance and exit 15. The hot water supplier comprises a shower 21 formed by a lattice-like combination of a plurality of pipes having a plurality of holes and a boiler 22 connected to the shower 21 supplying the hot water having a given temperature. The boiler 22 has a tank which reservoirs the hot water. In addition, it is possible to make use of the hot blast supply furnace 1 as a boiler. In that case, since the hot water supply pipe 23 connecting between the shower 21 and the boiler 22 becomes long, it is preferable to apply a heat shut-off treatment sufficiently. Further, the size of the drops of the shower sprayed by the shower 21 is preferably more advantageous as large as possible, because the temperature of those is hard to decrease.

The woods 24 are piled up on the truck 25 in plurality through the crosspieces 26. The truck 25 having wheels 27 runs on the rails 28 (FIG. 2) provided through the hot water supplier 3 into the treatment chamber 2. The woods 24 are preferably put on the truck 25 so spaced as to be exposed to the hot blast uniformly with each other. It is possible to drive the truck 25 by being trailed with a forklift and so on or trailing it with an exclusive winch. Now, one of the woods 24 is selected and attached with sensors 32 for sensing the temperature and humidity of the wood (hereinafter referred as "wood temperature and humidity sensor") on the surface, and embedded in the midst of the wood and in the intermediate portions therebetween. By measuring directly the temperature and the humidity of the wood under the treatment by the above control means and referring to the values gotten, the treatment proceeds.

Figure 4:
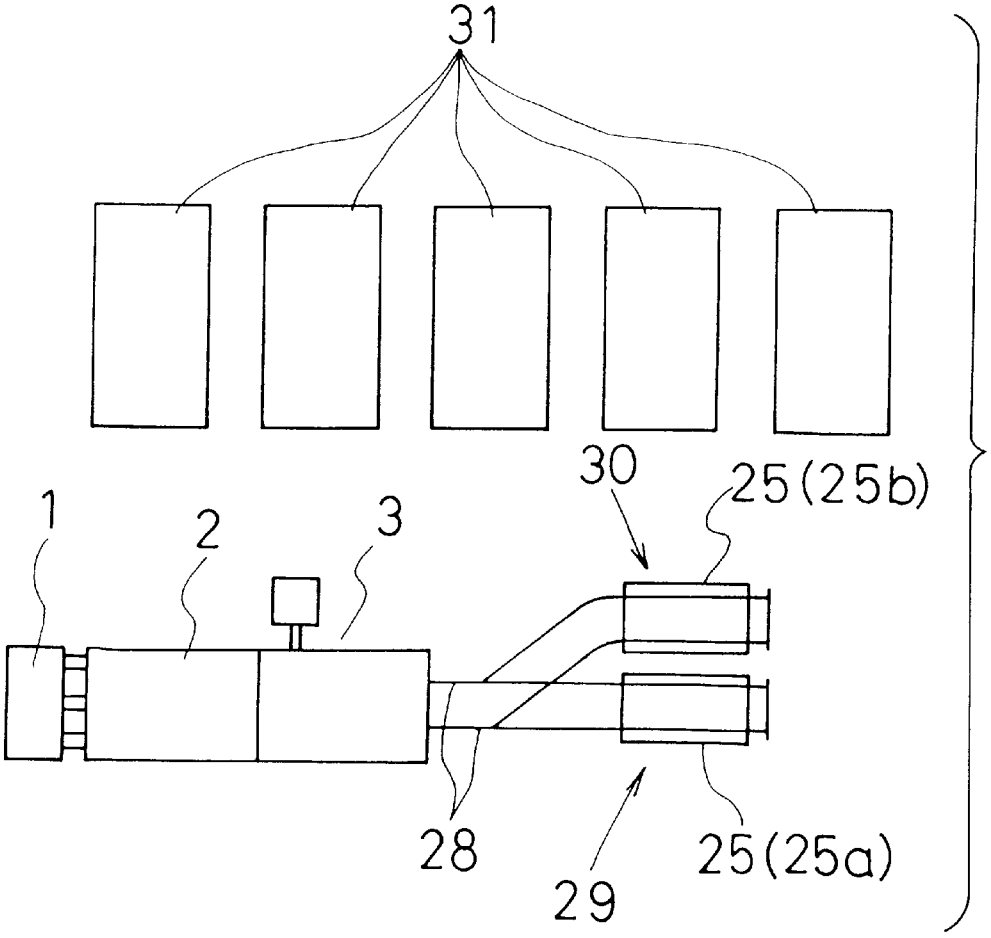
FIG. 4 is a plan and schematic view of the factory having the woods treatment apparatus shown in FIG. 1.

In FIG. 4, an example of the arrangement of a treatment factory in which the woods treatment apparatus is used is shown. The rails 28 extend from the hot water supplier and branch on the way and reach respectively to two wood loading and unloading platforms 29 and 30. Thus, if two trucks 25 are ready, when one truck 25*a* is in the treatment chamber 2, the other truck 25*b* can be ready for loading and unloading the woods or for loading the green woods to be next in the treatment cycle. In addition, in a drying process later described, a plurality of storage houses 31 for protecting the woods from rain (such as vinyl houses) are provided.

Here, the processes for improving the nature of the woods according to the present invention are explained using the wood treatment apparatus illustrating the present invention.

(1) The green woods are loaded on the truck 25 at the platform 29, 30 as shown in FIG. 4, and the truck 25 is moved into the treatment chamber 2. One of the woods to be treated is selected at random and the temperature and humidity sensors 32 are attached on the surfaces, embedded in the midst of the wood and therebetween.

(2) The door 16 of the treatment chamber 2 is sealed as shown in FIG. 1.

(3) The fuel 5 in the hot blast supply furnace 1 is burned, and the hot blast is supplied through the duct 8, the damper 13 of which is opened to the treatment chamber 2.

(4) The temperature in the treatment chamber 2 is increased to the temperature corresponding to the kind of the woods to be treated, and the woods 24 are heated. According to the increase in the temperature of the woods 24, the moisture contained in the woods 24 is vaporized and the inside of the treatment chamber 2 is filled with the saturated vapor.

(5) The control means control the damper 13, the stirring fans 17 and the ventilators 18 to maintain the temperature and the humidity (saturated vapor) constant and uniform during a given period of time. The woods 24 are steamed in the treatment chamber 2 filled with the saturated vapor, and the tissue of the woods is softened.

Figure 5A:
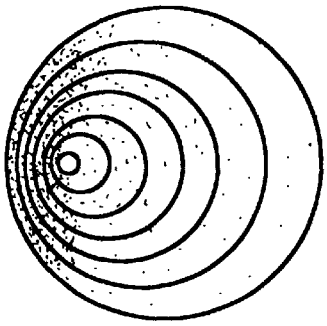
FIG. 5 shows the distribution status of the lignin and the cellulose by dots, wherein (a) shows one before the nature change and (b) shows one after the nature change.
Figure 5B:
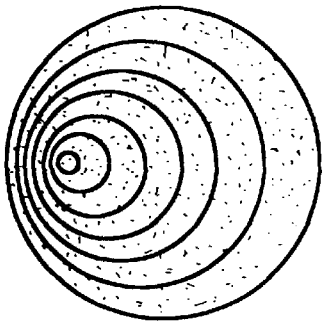

(6) In the stage of green woods, the lignin and the cellulose which constitutes the wood portion, as shown in dots in FIG. 5 (*a*), are concentrated on the portion where the annual rings are dense. However, by applying the process (5), the lignin and the cellulose are melted inside the wood, penetrated through the conduits and the fibers of the wood, dispersed, as shown in FIG. 5 (*b*), to the whole and distributed uniformly (i.e., nature-improved). At the same time, most of the resin contained in the wood is melted and leaked out from the small openings of the wood and the small amount of the resin which remains in the resin bags (in which the resin is stored) is not leaked out in melting any more. In this process the conduits of the wood are opened.

(7) After the given period of time in the step of (5), at a decreasing rate equal to the increasing rate in step (4), the temperature of the treatment chamber 2 is decreased.

(8) At the time when the temperature in the midst of the wood decreases to about 75° C., the door 16 of the treatment chamber 2 is opened, and the truck 25 is drawn out to the position of the hot water supplier 3.

(9) Here, the hot water boiled in the boiler 22, is sprayed from the shower 21 and the hot water penetrates into the woods 24. Since an amount of the moisture of the woods 24 has been vaporized in the treatment of the step (5), the penetration of the hot water is excellent. And, the temperature of the hot water at the moment is more than the temperature of the core of the wood 24, that is, it is at 80–90° C. Further, the amount of spray is a rate of three tons for each 200 $m^3$ of the woods 24. Care must be taken, as mentioned previously, because the conduits of the woods are opened and the woods absorb the hot water more than necessary, to avoid excessive spraying of hot water on the wood. By the way, when the temperature of the core of the woods 24 is about 70° C., the surface temperature of the woods is lower, but by penetrating the hot water from the surface, the temperature of the whole woods becomes approximately uniform.

(10) After spraying in a given amount of the hot water, the truck 25 is moved again to the loading and unloading platform 29, 30 for the woods (FIG. 4), and the woods were unloaded from the truck and transferred to a storage house 31. As the storage house 31, a vinyl house having an opening at the end thereof is appropriate and the woods are stored therein to protect the woods from rain and from being openly exposed to the atmosphere. While the temperature of the woods 24 decreases to a normal, or atmospheric, temperature the resin which remains in the resin bag is solidified to an amber-like state. Thus, the remaining resin, even if it is exposed to high temperatures such as being exposed to the sunshine, it is not melted and does not leak out. Further, as stated in step (6), the conduits of the woods 24 are opened, so that the vaporizing is accelerated and the period of time for the temperature of the woods 24 to return to the normal one is shortened by such as evaporation heat. By the way, when the woods are exposed to the moisture of such as rain drops during the drying process, corrosive fungus is apt to be introduced into the woods, against which a caution is required. The woods 24 are dried naturally to a moisture content rate of about 15% (according to the Building Standard Act). Although the period of time needed for drying depends on the kind of the woods and for various woods, it is from 1.5 to 2 months. Further, after the treatment of the step (9), the truck 25 can again be moved into the treatment chamber 2, and the treatment chamber 2 used as a forced drying machine. In this case, the period of time needed for drying the woods to the moisture content rate of about 15% (according to the Building Standard Act) is shortened to as little as four days. It is a matter of course that it is possible to dry the woods 24 in a drying machine provided separately. That is all the steps for treating the woods.

Figure 6:
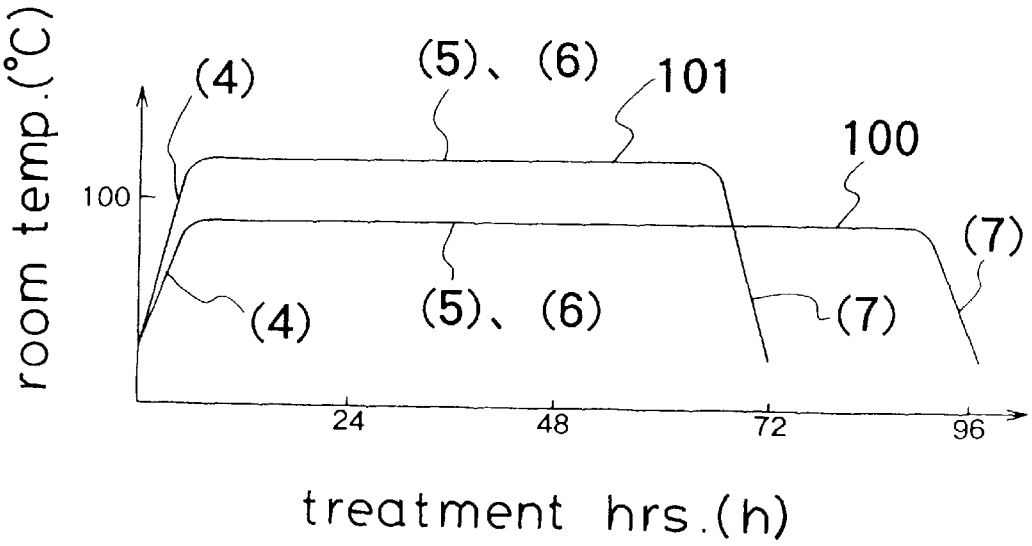
FIG. 6 shows a temperature changing graph of the treatment chamber while treating the woods according to the embodiment of the present invention.

Now, the necessary time for the steps from (4) to (7) and the given temperature of the treatment chamber 2 depend on the kind of the woods to be treated. Here, as the kind of the wood, it can be sufficiently differentiated into two different kinds, i.e., broadleaf trees and needle-leaf trees. Hereinafter, referring to FIG. 6, the treatment contents to the broadleaf trees and the needle-leaf trees are explained.

To the broadleaf tree, as shown by line 100, the necessary period of time from the step (4) to the step (7) is about four days (96 hours), and the temperature of the treatment chamber 2 is about 90° C . On the other hand, for the needle-leaf tree, as shown by line 101, the given period of time is about three days (72 hours), and the temperature of the treatment chamber 2 is about 120° C. The difference is derived from the following reasons. The needle tree is faster in growing than the broadleaf. Accordingly, the mesh of the annual ring of the needleleaf tree is larger or looser than the one of the broadleaf even though the diameter of the tree is the same. Therefore, the period of time to attain a given temperature till the midst of the wood is short, so that, it can be carried out to do the step of dispersing the lignin and the cellulose uniformly. Accordingly, by a treatment at the comparatively high temperature and in the short time period the woods can be improved in the nature. On the contrary, the broadleaf tree is concentrated in its annular ring, for improving the nature an increased time is needed. Accordingly, a treatment at comparatively low temperature and for a long period of time is necessary for the woods to be improved in the desired nature.

At the drying step (10), the period of time necessary for drying naturally takes more than two months for the broadleaf tree and 1.5 month for the needleleaf tree. However, in the case of a zelkova tree (Keyaki), it has been kept as it is for a term of 10 years until it becomes usable as lumber for building use after cutting down, but according to the present invention, it becomes usable as lumbers for building use in the term of more than two months.

The effects obtained from the elements illustrated in the above embodiment are as follows.

In the method of treating the woods, first the woods are put in the treatment chamber 2 and sealed. And, by increasing the temperature of the treatment chamber 2 to a given value by feeding the hot blast from the hot blast supply furnace 1 to the treatment chamber 2, the woods 24 are heated. Wherein, the treatment chamber 2 is filled with the saturated evaporation generated from the moisture expelled from the woods, thereby all of the woods 24 are evenly steamed by maintaining the temperature and the humidity in the treatment chamber 2 constant. By keeping such state for a given period of time, the tissue of the wood is softened, and the materials, such as the lignin and the cellulose which are the elements of the wood and cause the generation of the ex post facto distortion, are melted and dispersed uniformly to the whole wood. In addition, in the treatment a certain amount of moisture of the wood is evaporated. Then, in the case of the wood, the tissue of which is rough, becomes closer in its tissue by shrinking. Since the woods 24 are steamed evenly all over, the progress of the above treatment is carried out uniformly.

As mentioned above, in the state of green woods, the lignin and the cellulose, which are the elements of the wood, are concentrated in the area where the annual rings are close. That is, in this state, since the internal stress balances itself, when the lignin and cellulose are distributed uniformly in the wood, the portion where the lignin and cellulose resided originally, generates gaps in its tissue. Accordingly, when returning to the normal temperature as it is, the internal stress loses its balance and cracking is generated. In the embodiment of the present invention, before the temperature of the woods, which are in the state of an improved nature, in which the lignin and the cellulose are distributed uniformly in a high temperature, decrease again to the temperature in which the lignin and the cellulose begin to solidify, more concretely, at the time when the core temperature of the woods becomes at approximately 75° C. the hot water of approximately 80–90° C. is sprayed, and the solidification of the lignin and the cellulose is provisionally prevented. As stated previously, a certain amount of water is evaporated from the wood, so that the hot water penetrates quickly into the wood. Where it fills in the gaps generated in the tissue and swells the tissue again as before the treatment is carried out. Thereby the balance of the internal stresses is restored. Further, since the temperature of the hot water is the same as the core temperature, the generation of the cracking due to the abrupt change of the temperature is prevented. As stated previously, since the conduits of the woods are opened, the penetration of the hot water is good, and the final drying process is also accelerated.

In the drying process, the prevention of the woods from getting wet with moisture, such as rain drops, allows gradual evaporation of the moisture that has penetrated into the gaps of the tissue, the tissue becomes stabilized with the uniform distribution of the lignin and the cellulose, and there is not a lack of the balance of the internal stresses when the normal, or atmospheric, temperature is reached. Accordingly, the generation of the cracking during the drying process is prevented, and the stable supply of the nature-improved wood becomes possible. In the nature-improved wood, the lignin and the cellulose are distributed uniformly in the whole wood, so that, there is no ex post facto distortion, etc., and it presents a supreme lumber for building use.

Thus, by holding the woods in the sealed atmosphere and at the given temperature and humidity uniformly for a given period of time, the lignin and the cellulose which is not distributed uniformly, and causes, if left in that state, generation of the ex post facto distortion, etc., are distributed uniformly (i.e., nature-improved), and the hot water is sprayed and penetrated in the woods and thereby the change of the internal stress due to the nature-improvement is achieved, and by which the cracking that has previously been generated in the conventional process when returning the temperature to normal is prevented. According to the process, the cracking which is generated in 80% of all the woods to be processed in the prior art can be prevented.

In addition, the part which has not been appropriate for a lumber for building use, such as sapwood, may not generate the ex post facto distortion and can also be used. Further, although the woods of the tropics are very rough in tissue, because of fast growth, and are not suitable as the lumbers for building use, due to the above nature-improvement, the tissue becomes dense enough to enable them to be used. And, still further, as to the woods, such as lumber from thining, an eucalyptus and a gum tree, which inherently can not be prevented from generation of the ex post facto distortion, the nature-improvement make it possible to make use of these woods as lumbers for building use. Thus, various kinds of effects are obtained.

Further, according to the woods treatment apparatus of the-embodiment of the present invention, since the stirring fans 17, the ventilators 18, the damper 13 of the duct 8 connecting the treatment chamber 2, and the hot blast supply furnace 1 are controlled by the control means based on the temperature and the humidity detected by the sensors 19 in the treatment chamber 2, thereby the temperature and the humidity in the treatment chamber 2 can be maintained constant and uniform. Therefore, the environmental conditions in which the temperature and the humidity are constant and uniform needed for evenly improving the nature of the woods can be obtained in the treatment chamber 2.

Further, there are provided three ducts 8, the extended portions 8*a* of which are disposed on the floor of the treatment chamber 2, and a plurality of jets 20 disposed appropriately, so that the hot blast is spouted in the treatment chamber 2 evenly and provides convection of the hot blast from the floor to the ceiling of the treatment chamber 2, accordingly the invention can maintain the temperature and the humidity of the treatment chamber 2 evenly and the inside of the treatment chamber 2 can be easily made the most suitable environment for improving the nature of the woods.

Further, the wood temperature and the humidity sensor 32 is embedded in the wood to be treated and based on the sensor 32, the temperature and the humidity of the wood can be directly measured and the timing of taking out the woods from the treatment chamber 2 can be known correctly. Because adjacent to the door 16 (inlet and outlet for woods) of the treatment chamber 2, the hot water supplier 3 is provided, it is possible to rapidly spray the woods taken out of the treatment chamber 2 with hot water. Accordingly, the progress of the wood treatment can be carried out more rapidly and effectively and the nature-improved wood obtained faster and constantly. Table 1 shows the conditions for improving sampled kinds of woods in accordance with the treatment method of the embodiment of the present invention.

TABLE 1

| | | heating temp. ° C. | heating hrs. H | seasoning hrs. (fixed time) |
|---|---|---|---|---|
| A | zelkova tree | 90–100 | 72–96 | 70 |
| | eucalyptus | 90–100 | 72–96 | 70 |
| | gum tree | 90–100 | 72–96 | 70 |
| B | white cedar (thining wood) | 90–120 | 60–84 | 70 |
| | cedar (thining wood) | 90–120 | 60–84 | 70 |
| | Japanese larch (thining wood) | 90–120 | 60–84 | 70 |

A: broadleaf tree
B: needle-leaf tree

The above numerals in Table 1 are in average, practically, while considering various values, the period of time, the temperature and the humidity are regulated suitably. For reference, in the above Table 1, the heating temperature and the heating hours show the ones of the treatment of the chamber 2 in the above steps (5) and (6) and the seasoning hours shows the one until the lignin and the cellulose in the wood are solidified after the spraying of the hot water in the step of (9).

Since the present invention is thus constituted, the following effects are obtained.

The woods are maintained at a given temperature and humidity uniformly in the sealed atmosphere for a given period of time, the materials, such as the lignin and the cellulose, which are the components existing unevenly in the wood, and generate the ex post facto distortion, are melted and distributed evenly in the wood as a whole. By this process, the portion where the lignin and the cellulose are concentrated becomes thin in respect to the lignin and the cellulose to make that portion of the tissue porous. When returning to the normal temperature, the balance of the internal stress in the wood is broken and would be generated as found in the prior art. However, here, additionally, according to the present invention hot water of a given temperature is sprayed to penetrate into the wood and the gaps generated in the tissue are filled with the water to swell again the tissue of the wood as before and the balance of the internal stress is restored inside the wood.

During the drying process of the wood, as the moisture content rate decreases to a given value, due to the gradual evaporation of the moisture filled in the gaps of the tissue, the tissue adjusts to the state in which the lignin and the cellulose are distributed evenly, and the unbalance of the internal stress is prevented to improve the nature of the wood. Accordingly, although, in the conventional process, 80% of the woods to be treated have generated cracking, the present invention can prevent the generation of cracking and preclude the ex post facto distortion.

When carrying out the process for woods, the taking out the woods out of the sealed atmosphere at the time when the core temperature of the wood becomes less than a given temperature, and the temperature of the hot water to be sprayed is more than the core temperature, thereby, the provisional solidification of the lignin and the cellulose are prevented, and the gaps generated in the tissue of the wood are filled with the water and again the tissue is swelled as before, which maintains the balance of the internal stress of the wood. Then, as the hot water at a temperature of more than the core temperature is sprayed, the generation of the cracking due to the abrupt change of the temperature is prevented. Further, also by the coincidence of the rate of the increase and the decrease of the temperature in the sealed atmosphere, the generation of the cracking due to the abrupt change of the temperature is prevented. Thus, the cracking of the wood during the process of the treatment can be prevented and the stable supply of the nature-improved wood can be secured.

Further, the wood treatment apparatus according to the present invention can maintain the temperature and the humidity of the treatment room constant and uniform by controlling the stirring fan and the ventilator provided in the treatment chamber, and the damper of the duct connecting the hot blast supply furnace and the treatment chamber based on the temperature and the humidity of the treatment chamber which are detected by the sensor. Therefore, the most suitable circumstances for the wood treatment can be prepared. And, as the hot water supplier is prepared adjacent to the inlet and the outlet for the woods, it becomes possible to spray the woods with hot water rapidly taken out of the treatment chamber.

Further, by suitably distributing a plurality of jets on the floor of the treatment chamber, the hot blast can be jetted into the treatment chamber and the convection of the hot blast from the floor to the ceiling of the treatment chamber accelerated, so that, as the chamber temperature is maintained constant, it becomes easy to prepare the most suitable circumstances for wood treatment. In addition, in the present invention, since the sensor for detecting the temperature and the humidity is used for determining how to progress the treatment process, more accurate and effective progress for treating the wood can be achieved.

As stated above, by carrying out the wood treatment according to the present invention, it becomes possible to make use of woods previously considered non-usable in the conventional manner as the lumber for building use, and to cancel the idea to plant trees inclining toward the specific woods to contribute to maintenance of the ecosystem. Because the kind and the place where woods grow thick become usable, it is possible to reduce the price of the lumber for building use. Further, by reducing the volume of trees cut down, it can be planned to prevent destruction of nature.

What is claimed is:

1. An apparatus for treatment of woods, comprising:

a hot air supply furnace;

a treatment chamber;

a controller; and a hot water supplier adjacent to the treatment chamber, said treatment chamber being provided with a stirring fan, a ventilator and a sensor, said hot air supply furnace and said treatment chamber connected by a duct having a damper, wherein the controller controls operation of the damper, the stirring fan and the ventilator based on treatment conditions in the treatment chamber detected by the sensor.

2. The apparatus according to claim 1, further comprising a plurality of jets distributed on a floor of the treatment chamber.

3. The apparatus according to claim 1, wherein the apparatus comprises a second sensor for detecting the temperature and the humidity of the woods being treated.

4. The apparatus according to claim 1, wherein the treatment conditions detected by the sensor comprise temperature and humidity.

* * * * *